United States Patent [19]

Griffith

[11] Patent Number: 4,570,683

[45] Date of Patent: Feb. 18, 1986

[54] YARN HOLDING DEVICE

[75] Inventor: John D. Griffith, Tyne and Wear, England

[73] Assignee: Sulzer Brothers Limited, Winterthur, Switzerland

[21] Appl. No.: 736,553

[22] Filed: May 21, 1985

Related U.S. Application Data

[63] Continuation of Ser. No. 530,688, Sep. 9, 1983, abandoned.

[30] Foreign Application Priority Data

Jan. 16, 1982 [GB] United Kingdom ..... 8201211

[51] Int. Cl.[4] ..... D03D 49/70

[52] U.S. Cl. ..... 139/194; 139/302; 139/429

[58] Field of Search ..... 139/429, 435, 450, 194, 139/302, 303, 430

[56] References Cited

U.S. PATENT DOCUMENTS

| | | | |
|---|---|---|---|
| 3,908,710 | 9/1975 | Van Mullekom | 139/194 |
| 4,347,872 | 9/1982 | Brouwer et al. | 139/435 |

FOREIGN PATENT DOCUMENTS

| | | | |
|---|---|---|---|
| 7016178 | 5/1972 | Netherlands | 139/435 |
| 1085458 | 10/1967 | United Kingdom | 139/450 |
| 2065178 | 6/1981 | United Kingdom | 139/435 |

*Primary Examiner*—Henry S. Jaudon

*Attorney, Agent, or Firm*—Harding, Earley, Follmer & Frailey

[57] ABSTRACT

A yarn end holding device for a loom, the device including a fluid channel along which a fluid flow is directed to draw the yarn end into the channel and clamp means positioned to receive the yarn end and hold it during beat-up.

5 Claims, 4 Drawing Figures

YARN HOLDING DEVICE

This is a continuation of Ser. No. 530,688 filed Sept. 9, 1983, now abandoned.

The present invention relates to a yarn holding device particularly for use in a loom having a fluid weft insertion.

In a loom employing means for inserting a weft yarn by means of a fluid, the weft yarn is shot across the warp sheet by the fluid and it is necessary to hold the free end of the weft yarn on the far side of the warp sheet opposite to insertion during beat up in order to create the necessary tension in the weft yarn. This is achieved conventionally by either weaving the free end into a dummy selvedge which is subsequently removed or by pulling and holding the free end in a suction device by means of a frictional force created by a flow of fluid. In the latter case a sufficient length of weft yarn must be located in the suction device in order to create the necessary amount of frictional force for pulling and holding the weft yarn under a desired tension.

In both conventional methods the amount of weft yarn used is excessive and therefore adds a significant cost to the weaving of yarns using fluid insertion means.

It is a general aim of the present invention to provide a device for positively holding a relatively short free end of weft yarn thereby reducing the amount of weft yarn required.

According to one aspect of the present invention there is provided a yarn end holding device including a fluid channel along which a fluid flow is directed to draw the yarn end into the channel and clamp means positioned to receive the yarn end and hold it during beat up.

Preferably the clamp means co-operates with the beat up reed of the loom to tension the weft yarn during beat up. The clamp means advantageously includes a fixed jaw which is resilient and a movable jaw timed to open and close the clamp means in co-ordination with the beat up sequence of the loom. The degree of resilience of the resilient jaw is conveniently adjustable to vary the tension created in the weft yarn during beat up.

According to another aspect of the invention there is provided a loom including a holding device as defined above.

Various aspects of the present invention are hereinafter described with reference to the accompanying drawings, in which.

Figure 1:
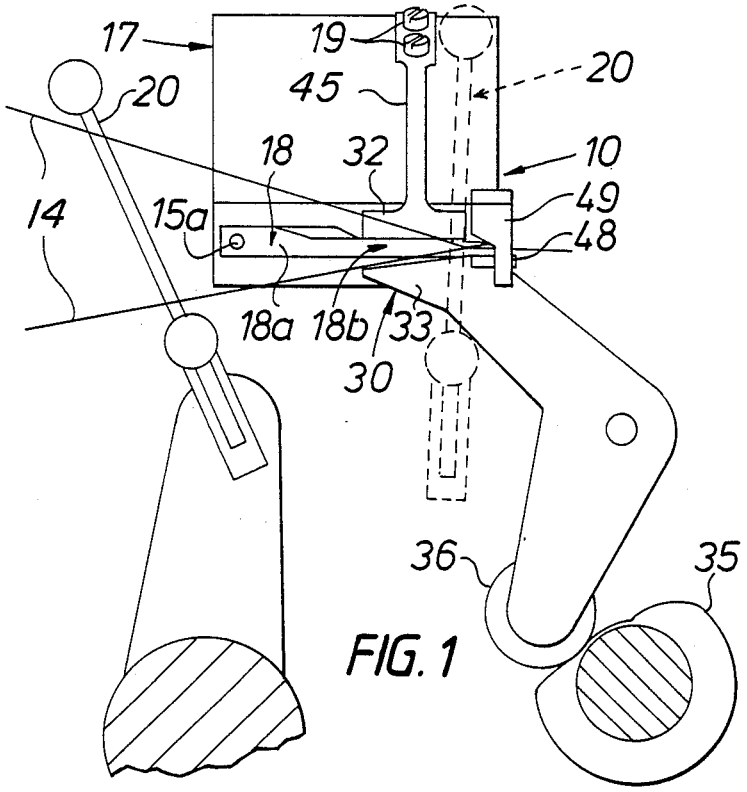
FIG. 1 is a schematic end view of a device according to the present invention shown in situ on a loom, the device being viewed in the direction of weft insertion.
Figure 2:
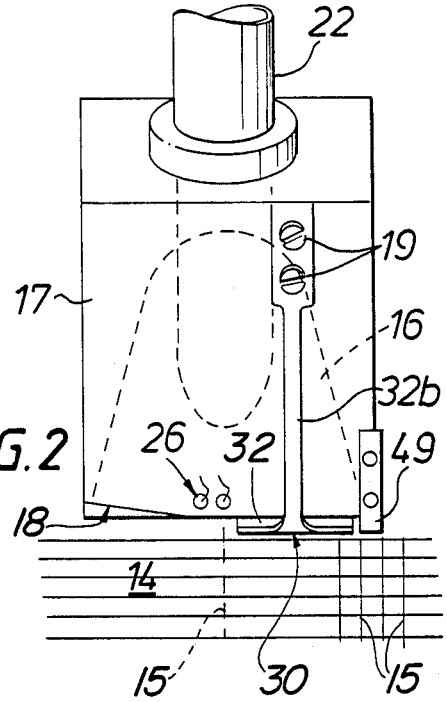
FIG. 2 is a schematic plan view of the device as shown in FIG. 1.

A holding device 10 is located on a loom frame 11 adjacent to the side 12 of the warp sheet 14 opposite to the side whereat the weft yarn 15 is inserted. The weft yarn end holding device 10 may be secured to the loom frame 11 by any conventional means such as, for example, bolts (not shown)

The device 10 includes a channel 16 defined within a stationary housing block 17, the channel 16 having a horizontally elongated mouth 18 facing the warp sheet. The length of mouth 18 is such as to extend along the warp sheet 14 for approximately the distance of travel of the reed 20 between weft insertion and beat up.

The mouth 18 has a relatively wide portion 18*a* positioned so as to receive the jet of air being directed across the warp sheet 14 for insertion of the weft yarn 15. The weft yarn end 15*a* enters the channel 16 through channel mouth 18. The air entering mouth 18 exits through a pipe 22 so that a flow of air is directed along the channel 16. The free end 15*a* of the inserted weft yarn 15 entrained in the air flow enters mouth 18 through enlarged mouth portion 18*a* and remains there due to the flow of air. If necessary, the flow of air through channel 16 may be supplemented or created by applying suction at the mouth 18 of the channel. This helps to position the yarn within the channel and may be achieved by feeding pressured air to the annular groove 22*a* which is permitted to enter the interior of housing block 17 via an annular gap 22*b*. The mouth 22*c* to pipe 22 is flared so that the pressurised air exiting from gap 22*b* flows into and through pipe 22, thus creating a vacuum in channel 16 by aspiration.

After insertion of the weft yarn, the beat up motion begins wherein the reed 20 begins to move towards the right as viewed in FIG. 1. Initially the reed 20 engages weft yarn 15 and moves it towards the fell so that the free end 15*a* therein is caused to move along the mouth 18 towards a relatively narrow mouth portion 18*b*. Advantageously a photo-sensor 26 is located within mouth 18 in the path of travel of free end 15*a* so that if the free end 15*a* is not detected after insertion the loom is stopped.

A clamp 30 is located adjacent the narrow mouth portion 18*b* and includes a stationary resilient jaw 32 and a movable jaw 33 which is conveniently operated via a cam 35 and cam follower 36. As the reed 20 moves the yarn end 15*a* into the narrow mouth portion 18*b* the clamp is operated by cam 35 to grip the yarn end 15*a* yieldingly between jaws 32 and 33.

Figure 3:
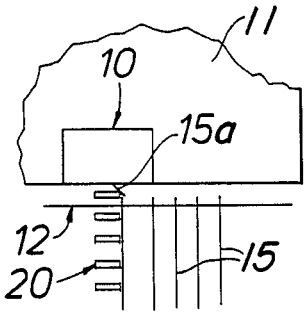
FIG. 3 is a schematic plan view similar to FIG. 2 illustrating beat up.
Figure 4:
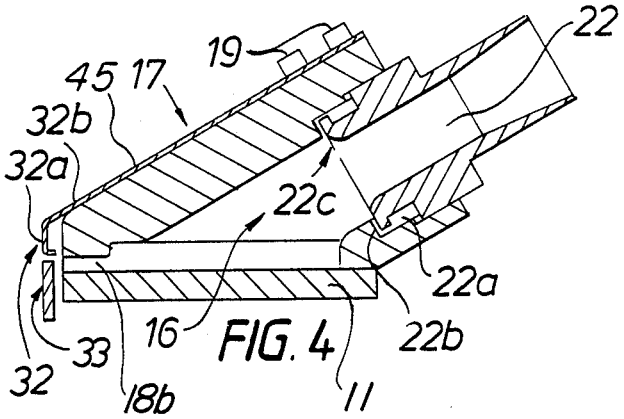
FIG. 4 is a side view partly in section of part of the device shown in FIG. 1.

Further movement of the yarn end 15*a* by the reed 20 initially is resisted by the clamp 30 and as viewed in FIG. 3, the yarn end 15*a* begins to trail behind the remainder of yarn 15 as yarn 15 is moved by the reed 20 towards the fell and consequently the yarn 15 is tensioned. Due to the resilience of jaw 32, the yieldingly gripped yarn end 15*a* is dragged in the direction of the fell by the reed 20 at a controlled rate dependent on the degree of resilience of jaw 32. Accordingly, the amount of tension created in the yarn 15 may be varied by altering the resilience of jaw 32. In the illustrated embodiment jaw 32 is formed from a thin sheet 45 of resilient material such as spring steel which is bent so as to form a jaw portion 32*a* depending from a support body portion 32*b*. A rigid slide member (not shown) may be located above body portion 32*b* to partially overlap it to define a flexing region between itself and jaw portion 32*a* and is secured to the housing block 17 by bolts 19 to secure the body portion in position. The resilience of jaw portion 32*a* may therefore be altered by varying the extent of the flexing region.

Advantageously, the free ends 15*a* after beat up may be trimmed from the weave selvedge by mounting a cutter blade 48 on movable jaw 33 and a co-operating blade 49 on housing 17 so that the ends projecting from the woven fabric beyond the fell are trimmed each time the jaw 33 is moved to engage jaw 32 and clamp yieldingly a newly inserted yarn end.

I claim:

1. A weft yarn end holding device for a fluid loom comprising a stationary housing secured to the loom frame, a fluid channel located internally of the housing along which a fluid flow is directed to draw the weft yarn end into the channel, the channel having an elongate mouth extending in the direction of the warp sheet of the loom, the mouth having a yarn receiving portion for receiving the yarn end after the weft yarn has been shot across the warp sheet, clamp means located in fixed position adjacent the mouth and including a pair of jaws extending between said yarn receiving portion of the mouth and the fell of the loom, one of the jaws being resiliently deflectable and at least one of the jaws being movable to effect opening and closing of the clamp means, and means to actuate the clamp means to open the jaws to receive a yarn end as the weft yarn moves toward the fell and to subsequently close the jaws to yieldingly grip the yarn end so that, on continued movement of the weft yarn toward the fell, the yarn end is dragged along the mouth and the clamp means and is tensioned thereby.

2. A device according to claim 1, wherein the clamp means comprises an upper jaw and a lower jaw, the upper jaw being resiliently deflectable and the lower jaw being movable relative to the upper jaw to effect opening and closing of the clamp means.

3. A device according to claim 2, wherein the lower jaw has mounted thereon a cutting blade which extends beyond the beat-up position of the reed, said cutting blade cooperating with a cutting blade mounted on the housing to define cutting means for trimming yarn ends.

4. A device according to claim 2, wherein said fluid flow along the channel is created or assisted by suction means arranged to create a suction effect at the mouth of said channel.

5. A device according to claim 2, wherein said fluid flow along the channel is created to assisted by suction means arranged to create a suction effect at the mouth of said channel.

* * * * *

UNITED STATES PATENT OFFICE

CERTIFICATE OF CORRECTION

PATENT NO. : 4,570,683

DATED : February 18, 1986

INVENTOR(S) : John D. Griffith

It is certified that error appears in the above-identified patent and that said Letters Patent are hereby corrected as shown below:

| | |
|---|---|
| Column 2, line 26 | delete "therein" |
| Column 2, line 29 | after "15a" insert --therein-- |
| Column 2, line 32 | after "located" insert --in fixed position-- |
| Column 4, line 17 | change "2" to --3-- |

Signed and Sealed this

*Twenty-seventh* Day of *May 1986*

[SEAL]

*Attest:*

DONALD J. QUIGG

*Attesting Officer*

*Commissioner of Patents and Trademarks*